United States Patent [19]

Fleissner

[11] 4,372,101

[45] Feb. 8, 1983

[54] APPARATUS AND PROCESS FOR PACKAGING SYNTHETIC FIBERS IN BALES

[76] Inventor: Hans Fleissner, Bettingerstr. 32, CH-4125 Riehen, Switzerland

[21] Appl. No.: 119,666

[22] Filed: Feb. 8, 1980

[30] Foreign Application Priority Data

Feb. 17, 1979 [DE] Fed. Rep. of Germany ..... 2906229

[51] Int. Cl.[3] ..... B65B 1/24; B65B 13/20

[52] U.S. Cl. ..... 53/435; 53/438; 53/522; 53/527; 53/529

[58] Field of Search ..... 53/438, 436, 435, 527, 53/529, 523, 522, 521, 513; 100/137, 41, 39, 207, 138–143; 198/472

[56] References Cited

U.S. PATENT DOCUMENTS

| | | | |
|---|---|---|---|
| 255,750 | 3/1882 | Wright | 53/513 X |
| 2,728,287 | 12/1955 | Tillinghast | 100/207 X |
| 3,721,060 | 3/1973 | Quinto | 53/529 X |
| 3,759,010 | 9/1973 | Boggs | 53/527 X |
| 3,765,143 | 10/1973 | Ippolito et al. | 53/436 |
| 3,773,190 | 11/1973 | Ishida et al. | 198/472 X |
| 3,964,232 | 6/1976 | Bender et al. | 53/438 X |
| 4,075,942 | 2/1978 | Johnson, Jr. | 100/137 X |
| 4,162,603 | 7/1979 | Strömberg | 53/438 |

FOREIGN PATENT DOCUMENTS

| | | | |
|---|---|---|---|
| 1239656 | 5/1967 | Fed. Rep. of Germany | 53/436 |

*Primary Examiner*—Nicholas P. Godici
*Assistant Examiner*—K. Y. Lin
*Attorney, Agent, or Firm*—Paul M. Craig, Jr.

[57] ABSTRACT

A process for forming synthetic fibers into bales by multi-stage compression involves feeding the synthetic fibers to a plurality of depositing units wherein the fibers are precompressed into a retaining bin positioned at each of the depositing units to form a precompressed fiber parcel and then a plurality of the retaining bins are routed via guide means along a single continuous path to a central press unit wherein the parcels within the retaining bins are successively subjected to a finishing compression to form bales and, thereafter, the compacted bales are removed successively from the retaining bins and the empty retaining bins are, successively, returned along a single guide path back to individual guide paths leading to the depositing units.

27 Claims, 16 Drawing Figures

Fig.1
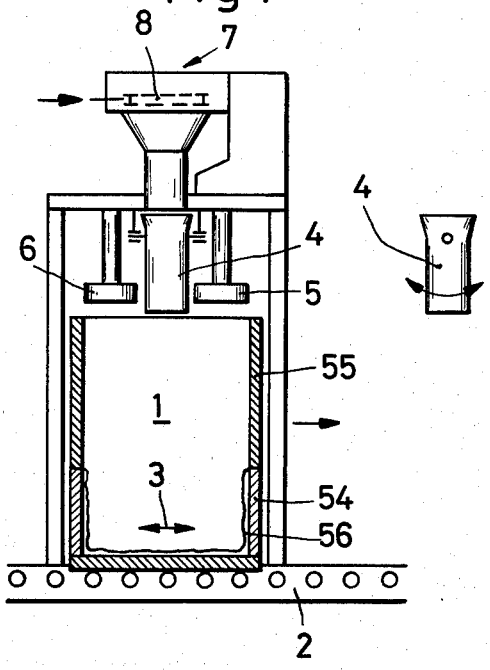
Fig.2
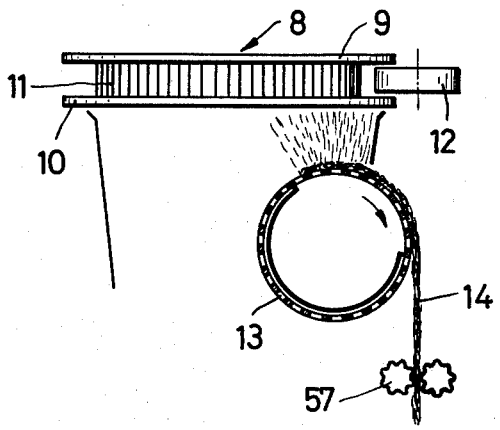
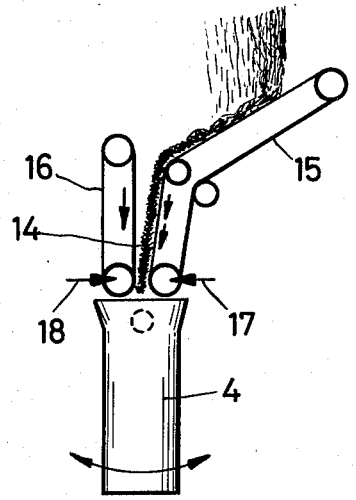
Fig. 3
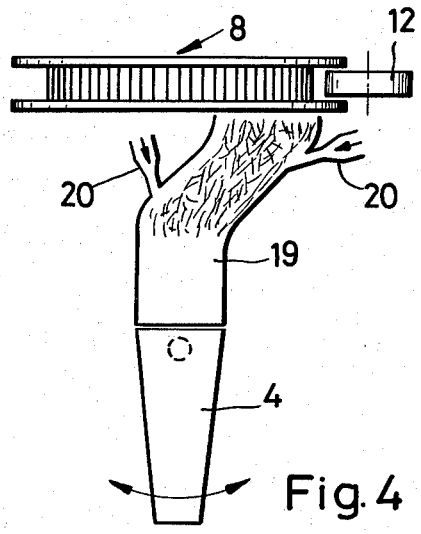
Fig. 4

APPARATUS AND PROCESS FOR PACKAGING SYNTHETIC FIBERS IN BALES

It is conventional to compact synthetic fibers which have been cut or torn into relatively small pieces by the use of a press and to produce reinforced bales for the further transport of these compacted fibers. This is done by conveying the staple fibers, produced, for example, by a cutting machine, pneumatically to a mat-forming unit or compactor arranged at a high level above a press and having the fibers transferred by this mat-forming unit or compactor initially to a rough press. Since cut fibers conveyed pneumatically occupy a relatively large volume, it is customary to provide presses of great height with long press rams to obtain bales having an adequate weight per unit volume. However, it is impossible to produce, by means of a single pressing step, a small bale having the large weight possible per cubic meter so that, in the known presses, the precompressed bale is transported into a finishing press integrated into the rough press and disposed directly beside the rough press.

These presses, called carrousel presses due to their construction, are provided in all cases following a continuous line for the manufacture of staple fibers. Thus, for each fiber-manufacturing line such a press must be provided. This is not only disadvantageous because the machine is very expensive due to its large volume with high dimensions, but also because a relatively large number of personnel is required for the operation of this machine, which is associated with only one fiber line. Another disadvantage of this machine resides in that the fibers must be conveyed pneumatically along perhaps a rather long path, during which step there can be braid formation, i.e a twisting of the fibers, which is deleterious to further processing. Besides, the long transport paths are contaminated and in some cases clogged by adhering fibers so that it is necessary to conduct an expensive cleaning of the press, including the long flock guiding elements, especially in case of colored fibers when it is intended to change the bath. Another expensive item is the weighing device required at these presses for establishing a uniform bale weight.

In addition to this manner of producing conveyable amounts of synthetic fibers for loose fiber material, it is also known to deposit endless fiber strands in transportable cartons. A relatively high filling weight of a carton is made possible when using the arrangement of German Pat. No. 1,239,656 according to which the strands, deposited continuously by a pivotally mounted trunk, are continuously compacted by two press rams arranged laterally of the trunk.

Although a higher weight per unit volume can be attained per packaging unit by the compacting of the fiber strand deposited in a carton; This compacting method has been considered inadequate in view of a possibility of improving the compacting effect on a purely theoretical basis; it has been necessary to provide a press even for deposited endless strands. Such a press has been proposed specifically for synthetic fibers in the German Patent Application P 27 36 316. This press consists of a unit arranged separately from the depositing device with the precompression device. This arrangement affords the advantage that the press can be fed from several fiber lines or from the depositing devices arranged at the ends of these lines. Thus, the press provided centrally for a plurality of lines can operate even if one or the other line is at a standstill. Depending on the arrangement of this press, the compressing step, including the reinforcing of the finished, compacted fibers and also the conveying steps to the press and away from the press, can be automated so that when producing fiber bales from fibers coming from several fiber lines, only a small number of operating personnel is required.

The invention is based on the object of developing a process, by means of which the packaging of loose fiber material into transportable units such as bales having an adequate weight per unit volume can be simplified. In this connection, all of the disadvantages exhausted in the conventional presses for flock material are to be avoided. These disadvantages are understood to be, in particular, the heretofore required, large carrousel presses arranged at the end of each line; the conveying paths required for filling these presses with the concomitant danger of intermixing of the conveyed fibers with the fibers from preceding batches adhering to the various conveying elements, with in some cases differing fiber properties, such as fiber length, color, fiber thickness, type of fiber, and the like; the compactors arranged in front of the rough press; and also the production of the bales requiring a large number of personnel.

This object has been attained by the invention by providing that the fibers delivered by a cutting machine are fed continuously to a depositing unit and are preliminary compacted at this point in a retaining bin during the depositing procedure preferably in a continuous manner; thereafter the precompressed fiber parcel is transported to a central press also supplied from other depositing stations; the parcel is subjected to a finishing compression step therein; and then the resultant compressed product is packaged.

When applying the process followed in the packaging of endless synthetic fibers in connection with the press according to the German Patent Application P 27 36 316, one advantage of the process of this invention resides in that the depositing device as well as the press can be utilized for loose fiber material as well as for endless synthetic fiber strands. To make this possible, it is merely necessary, for the packaging of fiber flocks, to associate a cutting machine with a depositing unit including the rough press unit. Thus it is advantageous, for example, if the cut fibers, due to their own gravity, fall automatically and continuously into a depositing unit. Consequently, only very short guidance distances are required for the flock material entering the packaging unit so that, when feeding another strand with fibers having different properties, a quick cleaning of the depositing elements without any problems can be carried out.

The essential idea for the production of bales from flocks according to this invention, therefore, is the separation of the depositing unit with the rough pressing unit from the main or final press. The main press operates for several lines so that this machine, which is quite expensive, does not come to a standstill if a line is unproductive for some reason.

The flock material can be deposited in the retaining bin with the aid of a rotatably supported depositing arm and/or in connection with a container moving to and fro in a reciprocating fashion. This mode of depositing ensures a uniform filling of the retaining bin. Guide elements can be arranged on the way to this retaining bin, producing a band-shaped mat or the like extending over a certain width, optionally the width of the depositing element or even the bin.

A band-shaped mat produced for depositing purposes is of advantage if the fibers are to be fed to the depositing unit in a maximally loosened condition. This is desirable, for example, in case of polyacrylic fiber. In this instance, it is possible to open the fibers by means of air prior to being deposited, and then to combine the fibers before depositing into a band-shaped fleece. In case of other fibers, a lesser opening up can be of advantage; the desired degree of opening of the fibers can be controlled by correspondingly regulating the air feed. Thus, for example, in case of polyester fibers the fibers, cut into staple, are to be conveyed in dense association continuously from the cutter and fed directly to the depositing unit unchanged without opening up—similarly to an endless strand.

As mentioned above, the essential idea of the process of this invention resides in being able to transport a retaining bin with the precompressed, cut fibers along a predetermined path to a central press, as well as other further retaining bins of other cutting devices and associated depositing units via other, predetermined paths, so that the fibers of all retaining bins from many depositing units can be compressed in this central press in succession. The respective finally compacted bales are removed from the retaining bins so that the bins can be returned to the respective depositing unit.

It is, of course, also possible to coordinate one cutting device with several depositing units for the flock material. This is advantageous, for example, if it happens that one or the other of the depositing units becomes defective, which would result in rendering the manufacturing line operative.

The aforemention process of flock depositing plus compacting can be utilized just as well for endless fibers, by also conveying to the central press retaining bins with endless strands by way of other, predetermined paths or from the flock manufacturing lines, but now while circumventing the cutting machines.

Various possibilities are feasible for the depositing of the cut fibers into the retaining bin for the precompression of the fibers. Thus, it is possible, for example, to fill the cut fibers into a casing, such as a bag, that is placed in the retaining bin and that serves for package purposes; to precompress the fibers in the package casing; to move the retaining bin to the central press; to separate the retaining bin from the filled package casing; to move the filled package casing into the press, compact same, and then to seal this casing all around, in the pressed condition, and to reinforce the casing. The use of a package casing placed into the retaining bin prior to depositing of the fibers has the advantage that here, too, the fibers do not come into contact with the walls of the retaining bin, so that these walls need not be cleaned when the fibers to be packaged are changed. Besides, this feature facilitates automatic packaging, making it possible to transport the fibers, not as yet finally compacted, into the central press even without a retaining bin.

In view of the fact that cut fibers have a larger volume than endless synthetic fibers, it is expedient to make the retaining bin of a relatively large volume. In case the fiber material is to be deposited directly into the package casing, it is advantageous to make the retaining bin bipartite in its height and to arrange the package casing only in the lower section thereof. In this case, after depositing and precompressing the cut fibers, the upper section of this bipartite retaining bin is removed in the upward direction. The further transporting of the fibers then takes place merely together with the lower section of the retaining bin. This lower section is moved to the central press, and the working process is finished at that location.

However, it is also possible to package the fiber bale only after it has been subjected to the final compacting step. In such a case the retaining bin carrying the precompressed fiber is moved into the central press, wherein the retaining bin also serves to support the fibers and the bin from the bale is removed only after compacting, whereupon the bale is reinforced and optionally packaged in an airtight fashion later on.

For producing transportable bales of cut fibers, it is also advantageous to fashion the retaining bin of a greater width than height e.g., the bin has a width two times greater than its height. The fibers deposited therein are then uniformly compacted over the bottom surface by a press ram acting from the top toward the bottom and are pushed horizontally from the laterally opened retaining bin into a package casing with a press container surrounding this casing, for the purpose of conducting the finishing pressing step. Only in this press container is the bale then sealed all around and reinforced.

The apparatus for conducting these processes comprises, a container for the accommodation of the cut fibers directly associated with a cutting device, for example arranged underneath the cutting device and at least one press ram for the precompression step during the continuous depositing procedure. Thus, in contrast to the conventional process, the manufactured staple fibers are conducted immediately and continuously into a retaining bin serving, for example, only for precompression. This can be executed in various ways, attention being had in particular to the embodiments in the drawings. Various possibilities are available for transporting the precompressed fibers, together with the retaining bin, to the central press. Also in this connection, attention is invited to the embodiments shown in the drawings, wherein:

FIG. 1 shows a retaining bin together with the depositing unit,

FIG. 2 shows the cutting machine with a type of compactor,

Figure 5:
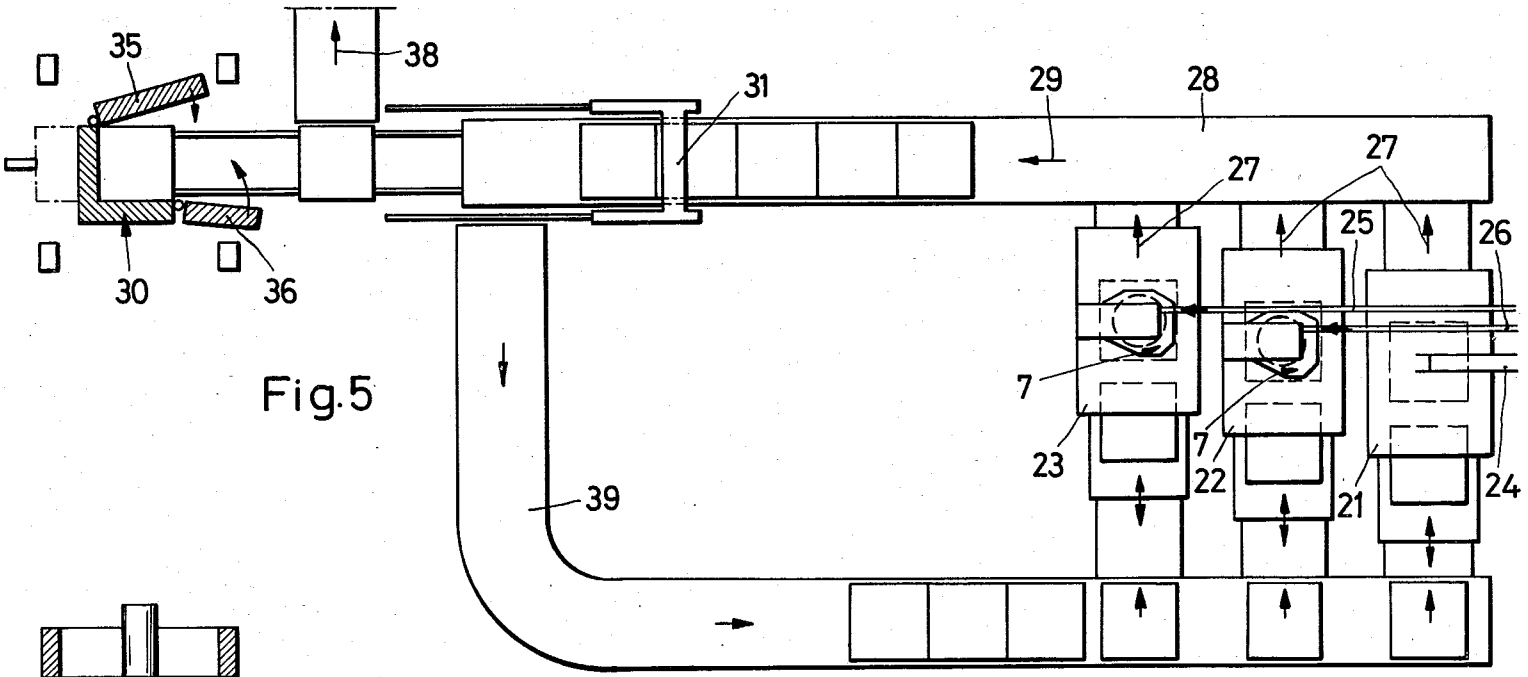
Figure 6:
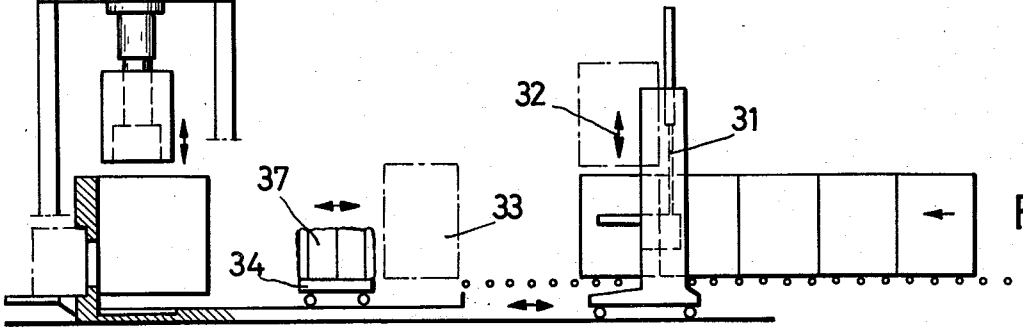
Figure 7:
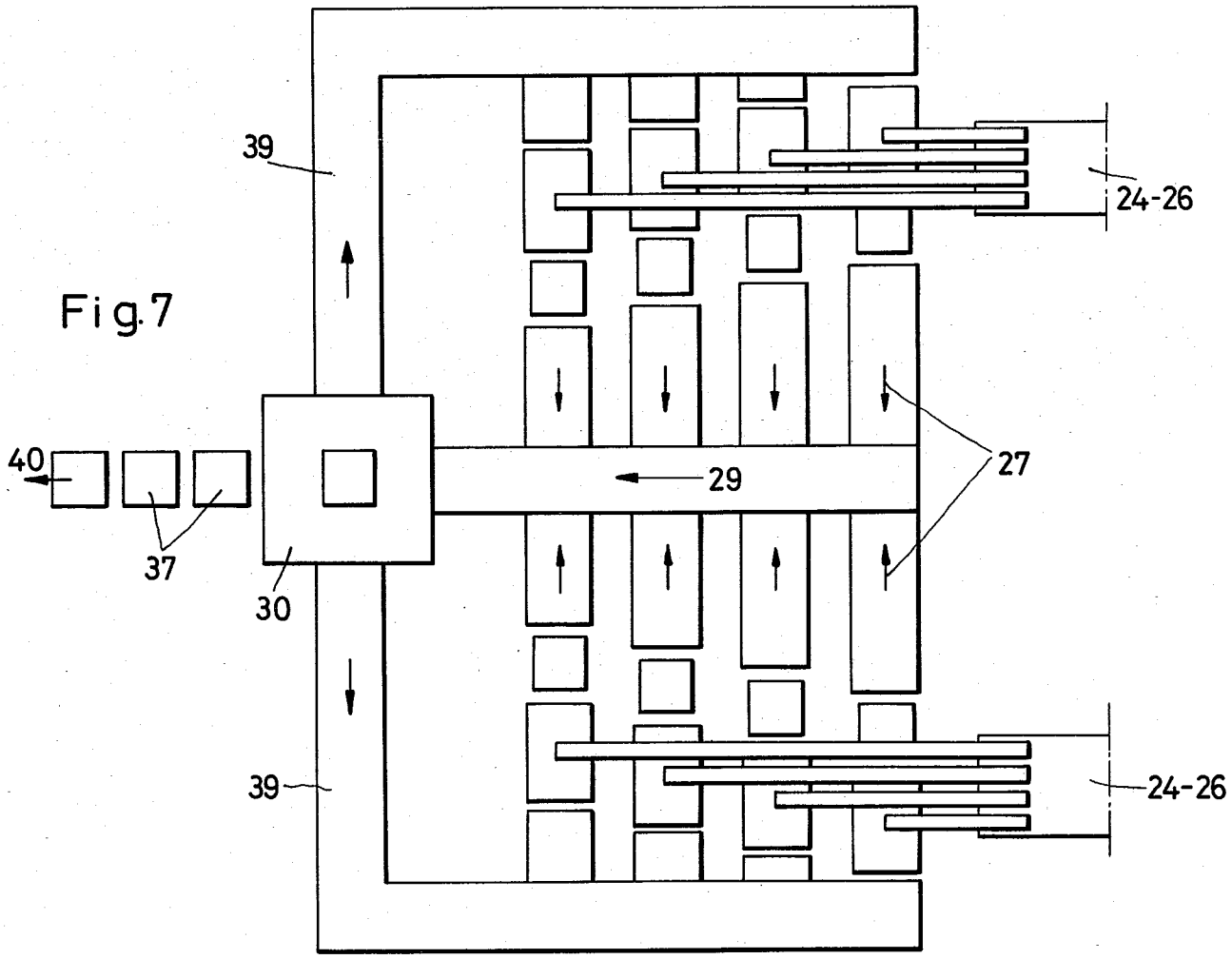
Figure 8:
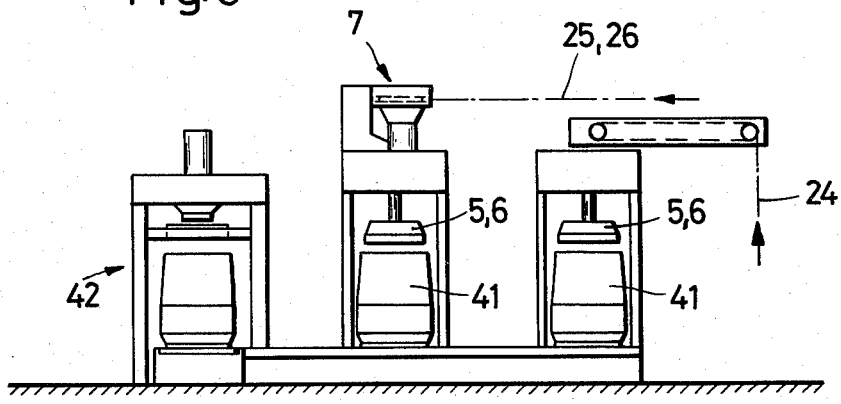

FIG. 3 shows a fleece-forming assembly underneath the cutting machine, illustrated in FIG. 2, FIG. 4 shows the cutting machine with a pneumatic fiber conveying means, FIG. 5 shows a top view of a plant assembly for the depositing and compacting of synthetic fibers, FIG. 6 shows a lateral view of the plant assembly shown in FIG. 5 in the zone of the press, FIG. 7 is a top view of another plant assembly for the depositing and compacting of synthetic fibers, FIG. 8 shows a plant assembly that is simplified as compared to those of FIGS. 5–7, in a lateral view.

Figure 9:
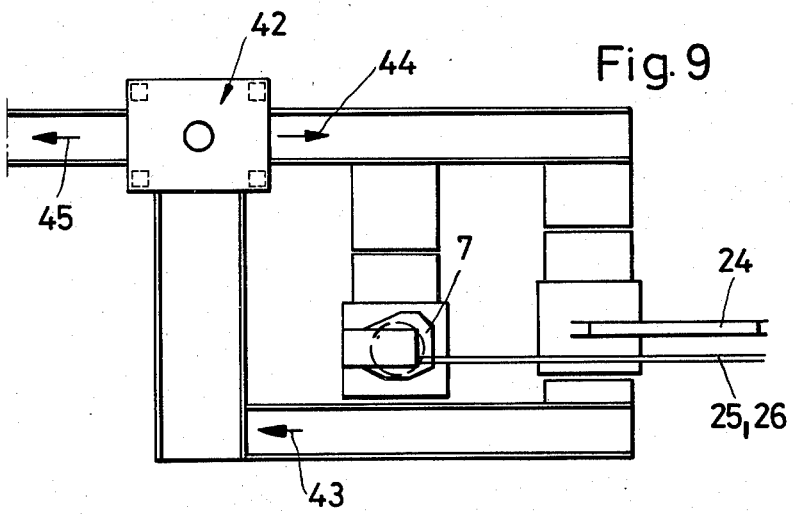
Figure 12:
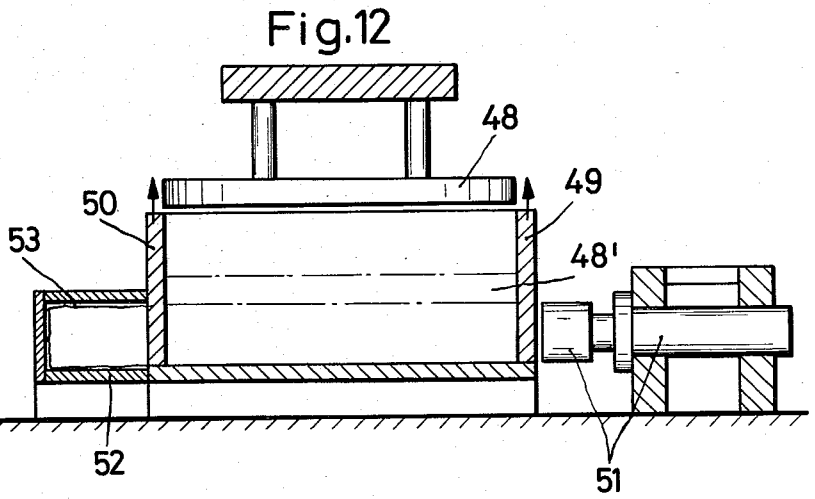
Figure 10:
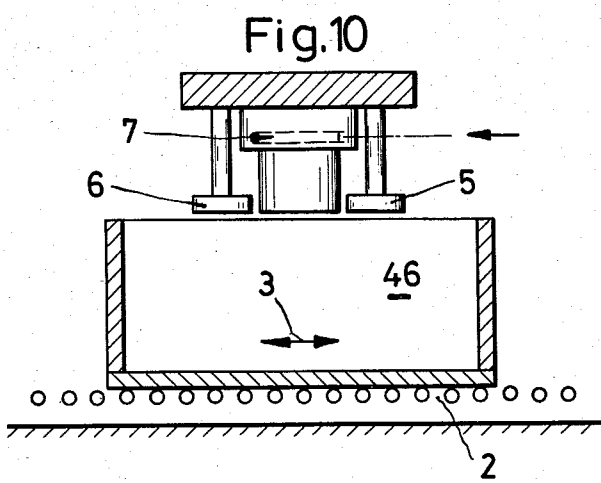
Figure 11:
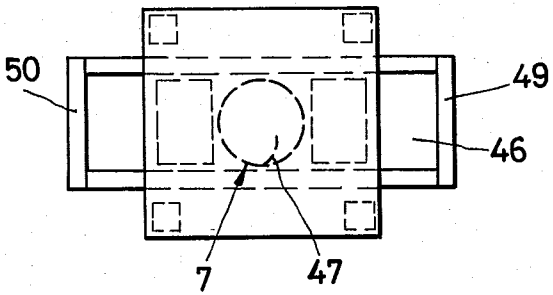
Figure 13:
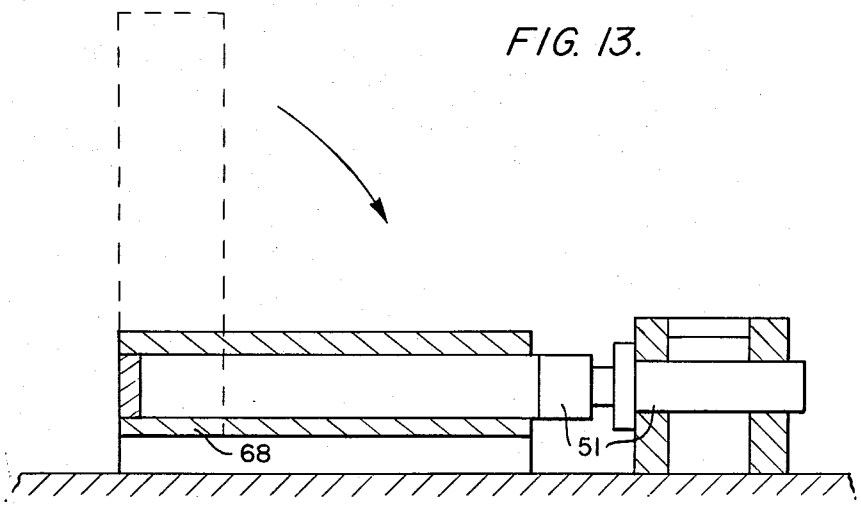
Figure 14C:
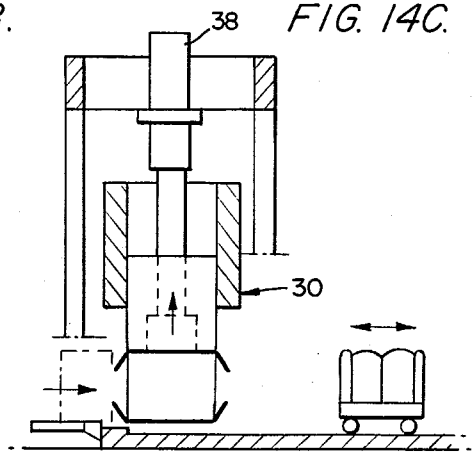
Figure 14B:
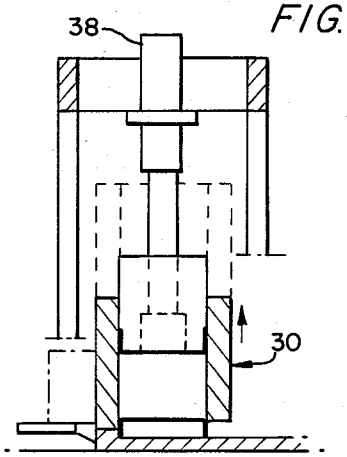
Figure 14A:
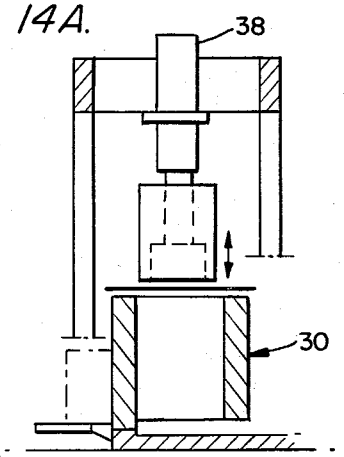

FIG. 9 is a top view of the plant assembly according to FIG. 8,

FIG. 10 shows a depositing unit of a different construction underneath a cutting machine, FIG. 11 shows a top view of the depositing unit of FIG. 10, FIG. 12 shows a press for the retaining bins relating to the depositing unit of FIG. 10, FIG. 13 shows a retaining bin which can be tilted by 90° for compressing in a horizontal direction, and FIGS. 14A through 14C show an apparatus with package material being shown in dark solid lines and being positioned to completely encompass the bale.

A depositing device or unit according to FIG. 1 is described, in principle, in German Pat. No. 1,239,656. This device consists of a retaining bin 1, moved to and fro in a reciprocating fashion by way of a roller train 2 in accordance with arrows 3. During the movement of the retaining bin 1, the fiber material is uniformly deposited over the base surface of this bin with the aid of the pivotably articulated depositing nozzle or chute 4 which may be oscillated to and fro in a vibrating fashion. Laterally of the nozzle 4, two press rams 5, 6 are arranged to alternatingly precompress the deposited fiber material in the retaining bin 1.

Above this depositing device, a cutting machine 7 is located, from which the fiber material, cut into staples, is directly introduced into the depositing nozzle 4. The cutting machine can also be arranged at some other location, for example at the same level in front of the depositing unit, from which then an additional conveying means leads to the depositing nozzle 4. In the embodiment of FIG. 2, the cutting machine consists of a rotatably supported cutting wheel 8 with two blade-supporting disks 9, 10 arranged at a mutual spacing of approximately the length of the blades; between these disks a plurality of radially outwardly oriented blades 11 is retained at a spacing corresponding to the desired staple length. A pressure roller 12 is disposed outside of and at a spacing from this blade cage to attain a radially inwardly effective cutting pressure on the strand wound onto the blades. The staple fibers produced with the aid of this pressure roller 12 and the blade cage will automatically fall downwards in the center of the blade cage 8 and are conveyed to the depositing nozzle 4.

In FIGS. 2–4, guide elements are illustrated between the cutting machine 7 and the retaining bin 1. According to FIG. 2, these guide means consist of a sieve drum under a suction draft in accordance with Patent Application P 26 23 948. With the aid of the suction draft produced by the fan arranged at the end face of the sieve drum 13, the staples forced through the cutting wheel in the zone of the contact roller 12 are directly sucked in and the fibers are transferred to the depositing nozzle 4 in the form of a fleece band or ribbon 14.

In FIG. 3, the sieve drum is replaced by two endless belts 15, 16 which are driven and which are aligned perpendicularly in the outlet zone; the lower belt 15 of these two belts is to rotate more quickly to push the flock material continuously together and thus to attain a preliminary compacting and an improved coherence of the band (see double arrow). The belts converge in a funnel-like manner in the lower zone to compress the fibers, falling from the cutting wheel 8 onto the portion of the endless belt 15, which portion is angled off, optionally also aligned horizontally, into a fleece ribbon 14. It is advantageous to arrange a pair of pressure rollers 57, preferably with a fluted surface, underneath the sieve drum 13 or underneath the endless belts 15, 16, to obtain a tooth-like crimp, in any event for further compacting the fleece or for producing a more readily guidable band. It is also possible to urge the two guide rollers 17, 18 of the endless belts 15, 16 into contact with each other, which is illustrated by the arrows. In any event, here again the fleece is transferred directly to the nozzle 4 for depositing into a retaining bin.

According to FIG. 4, the sieve drum 13 of FIG. 2 is replaced by a suction funnel 19, the suction opening of which terminates in the zone of the pressure roller 12 of the cutting wheel 8. It is sufficient in certain cases to convey the dropping flock material i.e. the cut fibers solely by means of blown-in air via the nozzle 20 into the nozzle 4 and out of this trunk. The air can also be effective at the cutting wheel 8 and through this cutting wheel. This embodiment has the advantage of providing a conveying path completely sealed off from the outside atmosphere.

Depositing and precompression devices according to FIGS. 1–4 are illustrated schematically in the right-hand portion of FIG. 5 in a top view. In this arrangement, three depositing units denoted by reference numerals 21–23 are disposed in series, each being supplied from another synthetic fiber manufacturing line. An endless strand 24 is conveyed to the depositing device 21 and is deposited, uncut, into the retaining bin 1. Above the depositing units 22 and 23, however, a cutting machine 7 is located which prior to depositing, cuts the endless strand 25, 26 into staple fibers. Once the retaining bin 1 is filled with a certain weight of fibers or with a certain length of the supplied fiber strand 24, 26, the retaining bin is pushed in the direction of arrows 27 onto the track 28. On the track, transportation of the retaining bins is executed in the direction of arrow 29 to the central press 30 located at the end of the line. Before introducing the precompressed fibers into the press 30, the retaining bin 1 is pulled off from the precompressed fiber material in the upward direction by means of the device 31. This is indicated with arrow 32 in FIG. 6. Subsequently the precompressed bale 33 travels to a press platform 34 which is moved via rollers into the press 30 together with the bale 33. Thereafter the pivotably mounted doors 35 and 36 are closed according to the arrows, and the bale 33 is compacted to the desired weight per unit volume with the aid of the press ram 38. The function of this press is described in detail in Patent Application P 27 36 316. After compression, the finished bale 38 is reinforced and then transported. During the compression step, the empty retaining bin has been moved via the track 39 back to the depositing stations 21–23.

FIG. 7 shows a similar arrangement for transporting the precompressed bales to the central press. The direction of movement of the precompressed bales to the press 30 is indicated by the arrows 27 and 29; the finished, compressed and reinforced bales 37 are carried away in the direction of arrow 40. A substantial difference with respect to FIG. 5, for example, resides in that in this embodiment the line 29 leading to the press 30 is supplied with precompressed retaining bins 1 from two sides. The number of possible precompressed bales supplied by the manufacturing lines depends on the cycle time of the press and on the efficiency of the lines.

In the embodiment of FIG. 1 in conjunction with the plane shown in FIGS. 5–7, the fiber material is deposited in a retaining bin 1 wherein the fiber material is merely precompressed and which is removed before the main compression step in the press 30. In the embodiment of FIGS. 8 and 9, an endless fiber strand 24 or a cut fiber material 25, 26 is deposited in a retaining bin 41 wherein the fiber material is not only precompressed with the aid of the press rams 5, 6, but is also subjected to the final compacting step. This main press is denoted by 42. The filled retaining bins 41 are transported in the direction of arrow 43 to the press 42; the empty retaining bins are returned in the direction of arrow 44, and the finished bales are carried away via the line 45. The separation of the retaining bin from the compressed bale, the reinforcement, and enveloping with a packaging material are conducted in a conventional manner.

FIGS. 10–12 show a depositing and compression means specifically only for loose fiber material; whereas the device of FIGS. 1 and 5–9 can also be utilized for endless strands. According to FIG. 10, the fiber strand, cut with the aid of the cutting device 7, is deposited in a retaining bin 46 which—as can be seen from FIG. 11—has a long basal surface, for the purpose of depositing the fiber material, discharged from the cutting machine 7, optionally with the aid of stripper means 47, as a band-shaped fleece extending, if desired, over the width of the cutting wheel 8, into the retaining bin 46 during the reciprocation of the latter.

A stripper is also advantageously provided in the other embodiments. This stripper should be arranged shortly behind the pressure roller 12—as seen in the direction of revolution of the cutting wheel 8. Also in the embodiment of FIGS. 10–12, a precompression is constantly effected with the aid of the press rams 5, 6. Due to the large content of the retaining bin 46, a large amount of cut fibers can be accommodated therein. After the precompression of the material with the aid of the press rams 5, 6, the retaining bin 46 is moved to the main press shown in FIG. 12. In this main press, the material is first of all again subjected to a precompression with the aid of the vertically lowerable press ram 48. In this case, the press ram extends over the entire base surface of the retaining bin 46. After precompression into position 48' the end faces 49, 50 of the retaining bin 46 are moved so that the horizontal ram 51 according to FIG. 12 can compress the fiber material in a finishing step from the right toward the left. For this purpose, a press box 52 is arranged in close proximity to the retaining bin 46, this box being provided with a packaging material, such as a bag 53. The material is pushed into this press box 52, namely with the aid of the press ram 51, and then compressed. Reinforcing is done as usual.

The idea of conducting the finishing compression step with the aid of a horizontally oriented press ram 51, however, is not only possible for flock material but also for endless strands. As usual, the endless strand is deposited in a retaining bin, which bin is standing upright, and the strand precompressed therein during depositing. For the finishing pressing step, the retaining bin travels to the horizontal press, for example according to FIG. 12, is tilted therein or upstream thereof by 90°, and the fibers are compacted by means of the press ram 51. To prevent the uppermost layers of the deposited strand from changing their position when the retaining bin is placed on end, it is possible to close the retaining bin directly above the precompressed strand parcel. A slide or the like is then removed again after the press ram 51 is started up.

Since flock material has a larger volume than deposited endless strands, the device of FIGS. 10–12 is especially advantageous for the packaging of flock material. However, the device of FIG. 1 can also be employed for flocks, if for this purpose the retaining bin is made to be higher than necessary for the depositing of an endless strand. To avoid wasting too much packaging material for a bale, the embodiment of FIG. 12 provides that the packaging bag 53 is filled only at the end of the pressing operation. In the embodiment of FIG. 1, in contrast to the above, the retaining bin 1 consists of two sections 54, 55, wherein merely the lower section of the retaining bin is lined with a bag 56. The upper edges of the bag are held between the sections 54, 55 of the bin. After the precompression of the flocks with the press rams 5, 6, the upper section 55 of the retaining bin is removed from the lower section, and then only the lower section 54 is conveyed to the press 30. At the press, the retaining bin may be covered with another packaging material so that the bale can be covered with the packaging material projecting at the bottom and at the top.

What is claimed is:

1. A process for forming synthetic fibers into bales by multistage compression, which comprises feeding synthetic fibers continuously to a plurality of depositing units; precompressing the fibers at the depositing units during deposition into a retaining bin positioned at each depositing unit to form a precompressed fiber parcel therein; transporting a plurality of the retaining bins containing the precompressed fiber parcels individually from each of the associated depositing units along first separate guide means to a first single guide means providing a single predetermined path extending from the separate guide means to a central press; then subjecting the fiber parcels within the retaining bins, successively, to a finishing compression within said central press to form compacted bales; removing the compacted bales, successively, from the retaining bins and then transporting the empty retaining bins, successively, along a second single guide means back to second separate guide means operatively associated with each of the depositing units for returning empty retaining bins thereto.

2. A process according to claim 1, wherein each depositing unit has a depositing means that is moved to and fro across a retaining bin.

3. A process according to claim 1 or 2, which further comprises cutting the fibers into staple length in a cutting machine positioned above the depositing unit and causing the cut fibers, due to gravity, to fall automatically and continuously into the depositing unit from the cutting machine.

4. A process according to claim 3, which further comprises forming the cut fibers into a band-shaped fleece extending over a predetermined width prior to being deposited into a retaining bin.

5. A process according to claim 3, which further comprises removing the fibers, cut into staple length in dense association continuously from the cutting machine and then delivering the fibers directly to the depositing unit.

6. A process according to claim 3, which further comprises opening up the cut fibers by an air stream before the fibers are deposited into the depositing unit and then supplying the fibers in the opened up condition to the depositing unit.

7. A process according to claim 1, which further comprises cutting the synthetic fibers to staple length above some of the depositing units and feeding the cut fibers to these depositing units and delivering endless strands to other depositing units, the retaining bins with endless strands being delivered to the central press via in said predetermined path as the retaining bins containing the cut fibers.

8. A process according to claim 3, which further comprises filling the cut fibers into a casing placed in a retaining bin for packaging said fibers; precompressing the fibers in the casing; moving the retaining bin to the central press via said first guide means; separating the retaining bin from the fiber filled casing; moving the fiber filled casing into the central press; compressing the fiber filled casing in the central press and then, in the compacted condition sealing and reinforcing the casing all around.

9. A process according to claim 8, wherein after depositing and precompressing the cut fibers into the casing, the upper section of a two section retaining bin is withdrawn in the upward direction, and then only the lower section, which alone holds the casing, is moved to the central press, and the pressing operation is completed therein.

10. A process according to claim 3, wherein the deposited, cut fibers are precompressed in a retaining bin, the retaining bin is moved to the central press, the fibers are compacted with the central press to form a bale and the retaining bin is removed, further comprising reinforcing the fiber bale in the compacted condition, and only then sealing the bale all around within a casing for packaging the bale.

11. A process according to claim 3, wherein the cut fibers are filled into a retaining bin provided on the bottom with a projecting package casing; the fibers are precompressed therein; and the retaining bin is moved to the central press, which further comprises covering the retaining bin at the press on the top side with another package casing; subjecting the fibers to a finishing step in the retaining bin; withdrawing a retaining bin without its bottom section in the upward direction past a ram of the central press; covering the bale with the packaging material projecting at the bottom and at the top; reinforcing the bale, removing the bale; and returning the retaining bin, lowered again, with its bottom to the depositing unit.

12. A process according to claim 3, wherein the deposited, cut fibers are precompressed from the top toward the bottom in a retaining bin and, during the final pressing operation in the press, are pushed from a laterally opened retaining bin horizontally into a package casing with a press box surrounding the casing and are simultaneously subjected to a finishing pressing operation therein and sealed all around.

13. An apparatus for producing bales of synthetic fibers which comprises a plurality of depositing units, means for feeding synthetic fibers continuously to said plurality of depositing units, each of said depositing units having means for precompressing the fibers during deposition into a retaining bin positioned at each of the depositing units for form a precompressed fiber parcel therein, first separate guide means for transporting a plurality of the retaining bins containing the precompressed fiber parcels individually from each of the associated depositing units along separate paths, a first single guide means for providing a single predetermined path extending from the separate guide means to a central press, said central press including means for subjecting the fiber parcels within the retaining bins, successively, to a finishing compression to form compacted bales therein, means for removing the compacted bales, successively, from the retaining bins, second single guide means for transporting the empty retaining bins, successively, along a single guide path and second separate guide means operatively associated with each of the depositing units for returning the retaining bins from the single path to the depositing units.

14. An apparatus according to claim 13, said depositing unit having a depositing funnel and a retaining bin moved in a reciprocating fashion perpendicular to said funnel, a press ram coordinated with the depositing funnel on both sides, the compacting motion of the press ram being coupled with the reciprocating motion of the retaining bin so that the compacting motion takes place respectively at the end of one of the reciprocating motions, a cutting machine arranged above the depositing unit, and at least one guide element arranged between the depositing unit and the cutting machine for guiding cut fibers continuously into said retaining bin.

15. An apparatus according to claim 14, wherein the guide element is a sieve drum under a suction draft.

16. An apparatus according to claim 14, wherein the guide element is a suction funnel with means for blowing the air into the funnel in the conveying direction of the fibers, the suction opening of the funnel being disposed in a zone where the staple fibers are produced at the cutting machine.

17. An apparatus according to claim 14, wherein the at least one guide element is two endless belts spaced from each other and rotating in opposite directions, optionally converging funnel-like toward each other, said belts seizing the cut fibers delivered by the cutting device and compacting the fibers together into a fleece.

18. An apparatus according to claim 17, wherein one of the endless belts rotates more rapidly than the other.

19. An apparatus according to claim 17 or 18, wherein a pair of pressure rollers is arranged at an outlet of a fleece-forming unit formed by the endless belts.

20. An apparatus according to claim 14, wherein the guide element is fashioned to oscillate to and fro in a vibrating fashion.

21. An apparatus according to claim 14, further comprising a package forming casing lining said retaining bin, the retaining bin being formed of upper and lower sections, and the casing being arranged to cover only the walls of the lower section.

22. An apparatus according to claim 21, wherein the bag is retained between the two sections during filling and precompression.

23. An apparatus according to claim 14, wherein the retaining bin has a width two times greater than its height.

24. An apparatus according to claim 23, wherein the retaining bin has movable walls along a lateral end face.

25. An apparatus according to claim 13, wherein the central press consists of two press rams aligned at right angles to each other, wherein the vertical ram compacts the fibers to the height of the horizontally oriented ram, and then the horizontal ram subjects the thus-precompressed fibers to a finishing pressing step.

26. An apparatus according to claim 25, wherein a press box is arranged at the end face of the retaining bin lying oppositely to the horizontal ram, said press box having the same cross section as the press ram of the horizontal ram, with an end face opened up toward the press ram; and the fibers, during the pressing operation by means of the horizontal ram, being pushed into this press box, optionally provided with a packaging casing, and subjected therein to a finishing pressing step.

27. An apparatus according to claim 13, wherein the central press is suitable for the compression of cut fibers as well as endless strands and has for the finishing pressing operation a horizontally oriented press ram; and the retaining bin, filled with an endless strand, is tilted for compressing purposes in a horizontal direction by 90°.

* * * * *